US005752144A

United States Patent [19]

Mammino et al.

[11] Patent Number: 5,752,144

[45] Date of Patent: May 12, 1998

[54] METHOD OF FABRICATING A RECLAIMABLE UNIFORM CONDITIONING BLOTTER ROLL

[75] Inventors: Joseph C. Mammino, Penfield; William G. Herbert, Williamson; Shu Chang, Webster; Theodore C. Ludwig, Fairport, all of N.Y.

[73] Assignee: Xerox Corporation, Stamford, Conn.

[21] Appl. No.: 625,391

[22] Filed: Apr. 1, 1996

[51] Int. Cl.[6] ..... G03G 15/11

[52] U.S. Cl. ..... 399/249; 492/52

[58] Field of Search ..... 355/256, 296, 355/297, 298; 492/51, 52, 53; 29/895; 430/125; 399/249

[56] References Cited

U.S. PATENT DOCUMENTS

| | | | |
|---|---|---|---|
| 4,286,039 | 8/1981 | Landa et al. | 430/119 |
| 4,501,646 | 2/1985 | Herbert | 204/4 |
| 4,985,733 | 1/1991 | Kurotori et al. | 355/282 |
| 5,133,125 | 7/1992 | Diebels et al. | 29/895 X |
| 5,136,334 | 8/1992 | Camis et al. | 355/256 |
| 5,332,642 | 7/1994 | Simms et al. | 430/125 |
| 5,424,813 | 6/1995 | Schlueter, Jr. et al. | 355/256 |
| 5,481,341 | 1/1996 | Sypula et al. | 355/256 |
| 5,493,369 | 2/1996 | Sypula et al. | 355/256 |
| 5,519,476 | 5/1996 | Dalal et al. | 355/256 X |

*Primary Examiner*—Nestor Ramirez
*Attorney, Agent, or Firm*—Tallam I. Nguti

[57] ABSTRACT

A method of fabricating a blotter roll for uniformly conditioning liquid images consisting of toner particles and carrier liquid. The method includes electroforming a semi-rigid resilient and perforated metallic substrate for preventing undesirable impressions of substrate outlines and footprints on an image being conditioned. The resilient metallic substrate is electroformed so as to be seamless and to have a cylindrical hollow interior, and first and second open ends. The method next includes forming at least a first absorbent foam layer over the semi-rigid resilient substrate for absorbing carrier liquid from the image being conditioned, and filling the cylindrical hollow interior of the semi-rigid resilient substrate using a porous foam insert for rigidifying the semi-rigid resilient substrate, and for uniformly spreading throughout the hollow interior, vacuum effects on the image being conditioned, of a vacuum source connected to the hollow interior for drawing carrier liquid from the image being conditioned.

4 Claims, 5 Drawing Sheets

METHOD OF FABRICATING A RECLAIMABLE UNIFORM CONDITIONING BLOTTER ROLL

BACKGROUND OF THE INVENTION

This invention relates to blotter rolls used for removing carrier liquid from toner images formed in liquid electrophotographic reproduction machines, and more particularly to a method of making a reclaimable, relatively inexpensive and uniform conditioning blotter roll.

Liquid electrophotographic reproduction machines are well known, and generally each includes a development system that utilizes a liquid developer material typically having about 2 percent by weight of fine solid particulate toner material dispersed in a liquid carrier. The liquid carrier is typically a hydrocarbon. In the electrophotographic process of such a machine, a latent image formed on an image bearing member or photoreceptor is developed with the liquid developer material. The developed image on the photoreceptor typically contains about 12 percent by weight of particulate toner in liquid hydrocarbon carrier. To improve the quality of transfer of the developed image to a receiver, the image is conditioned so as to increase the percent solids of the liquid developer forming the image to about 25 percent. Such conditioning is achieved by removing excess hydrocarbon liquid from the developed liquid image. However, such removal must be carried out in a manner that results in minimum degradation of the toner particles forming the liquid image. The conditioned image is then subsequently transferred to a receiver which may be an intermediate transfer belt and then to a recording or copy sheet for fusing to form a hard copy.

Liquid electrophotographic reproduction machines as such can produce single color images or multicolor images on such a recording or copy sheet. The quality or acceptability of a color copy produced as such is ordinarily a function on how the human eye and mind receives and perceives the colors of the original and compares it to the colors of the copy. The human eye has three color receptors that sense red light, green light, and blue light. These colors are known as the three primary colors of light. These colors can be reproduced by one of two methods, additive color mixing and subtractive color mixing, depending on the way the colored object emits or reflects light.

In the method of additive color mixing, light of the three primary colors is projected onto a white screen and mixed together to create various colors. A well known exemplary device that uses the additive color method is the color television. In the subtractive color method, colors are created from the three colors yellow, magenta and cyan, that are complementary to the three primary colors. The method involves progressively subtracting light from white light. Examples of subtractive color mixing are color photography and color reproduction. Also, it has been found that electrophotographic reproduction machines are capable of building up a full subtractive color image from cyan, magenta, yellow and black. They can produce a subtractive color image by one of three methods.

One method is to transfer the developed image of each color on an intermediary, such as a belt or drum, then transferring all the images superimposed on each other on a sheet of copy paper.

A second method involves developing and transferring an image onto a sheet of copy paper, then superimposing a second and subsequent images onto the same sheet of copy paper. Typically an image processing system using this method can produce a first color image by developing that color image on a photoconductive surface, transferring the image onto a sheet of copy paper, and then similarly and sequentially producing and superimposing a second, and subsequent images onto the same sheet of copy paper.

A third method utilizes what is referred to as a Recharge, Expose, and Develop or REaD process. In this process, the light reflected from the original is first converted into an electrical signal by a raster input scanner (RIS), subjected to image processing, then reconverted into a light, pixel by pixel, by a raster output scanner (ROS) which exposes the charged photoconductive surface to record a latent image thereon corresponding to the subtractive color of one of the colors of the appropriately colored toner particles at a first development station. The photoconductive surface with the developed image thereon is recharged and re-exposed to record the latent image thereon corresponding to the subtractive primary of another color of the original. This latent image is developed with appropriately colored toner. This process (REaD) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original.

Conditioning of liquid developer images formed by any of the above methods must be achieved without disturbing the toner image, and in such a manner as to prevent toner particles from entering the carrier liquid removal device. In particular, the image must be conditioned uniformly without the conditioning device leaving undesirable outlines or footprints of the conditioning device in the conditioned image and in the case of a perforated roller without appearance differences between pore and non-pore contacted areas of the image.

Various techniques and devices including perforated blotter rolls or rollers have been devised for conditioning the liquid developer. Such blotter rolls may include a vacuum removal system and an electrical bias applied thereto in order to assist the removal process. The following references may be relevant to various aspects of the present invention.

U.S. Pat. No. 4,286,039 issued Aug. 25, 1991, to Landa et al. discloses an image forming apparatus comprising a deformable polyurethane roller, which may be a squeegee roller or blotting roller which is biased by a potential having a sign the same as the sign of the charged toner particles in a liquid developer.

U.S. Pat. No. 4,985,733 issued Jan. 15, 1991, to Kurotori et. al. discloses a liquid toner copying machine including a non-thermal image conditioning apparatus comprising an elastic blotter roll and an elastic backup roller for bringing a liquid toner image carrying sheet into contact with the blotter roll.

U.S. Pat. No. 5,136,334 issued Aug. 4, 1992, to Camis et. al. discloses a liquid toner image conditioning apparatus including a heated inner core connected to a source of AC or DC bias, and having a smooth outer surface made of a soft elastomeric material.

U.S. Pat. No. 5,332,642, issued Jul. 26, 1994, to Simms et al. having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

Each of the above example references includes a currently conventional perforated blotter roller having a rigid core, and at least an absorbent layer over such core. It has been found that primary factors in the image disturbing characteristics of a conventional perforated blotter roller come, in part, from the inaccuracy, the lack of straightness, and total indicated runout (TIR) properties, of the rigid core. In addition, it was found that the structure of the liquid image conditioned with a conventional perforated blotter roller undesirably show significant evidence of pore hole outlines, and imprints or footprints from the substrate and from vacuum effect differences between pore and non-pore contacted areas of the image.

There is therefore a need for developing methods of fabricating image non-disturbing substrates or cores for such blotter rolls that overcome the above difficulties. In addition, there is a need for a method of producing such a blotter roll which is reclaimable in major part and produces uniform image conditioning.

SUMMARY OF THE INVENTION

In accordance with one aspect of the present invention, there is provided a method of fabricating a blotter roll for uniformly conditioning liquid images consisting of toner particles and carrier liquid. The method includes electroforming a semi-rigid resilient and perforated metallic substrate for preventing undesirable impressions of substrate outlines and footprints on an image being conditioned. The resilient metallic substrate is electroformed so as to be seamless and to have a cylindrical hollow interior, and first and second open ends. The method next includes forming at least a first absorbent foam layer over the semi-rigid resilient substrate for absorbing carrier liquid from the image being conditioned, and filling the cylindrical hollow interior of the semi-rigid resilient substrate using a porous foam insert for rigidifying the semi-rigid resilient substrate, and for uniformly spreading throughout the hollow interior, vacuum effects, on the image being conditioned, of a vacuum source connected to the hollow interior to draw carrier liquid from the image being conditioned.

Pursuant to another aspect of the present invention, there is provided a blotter roll for uniformly conditioning liquid images consisting of toner particles and carrier liquid. The blotter roll includes a surface foam layer having micro-pores for contacting an image being conditioned so as to absorb carrier liquid without removing toner particles, an absorbent intermediate foam layer formed underneath the surface foam layer for absorbing carrier liquid from the surface layer, an electroformed semi-rigid and resilient metallic substrate located underneath the intermediate foam layer and having a cylindrical hollow interior, perforations, and first and second open ends, and a rigidifying porous foam insert fitted within the cylindrical hollow interior of the semi-rigid metallic substrate for rigidifying the metallic substrate, and for uniformly spreading throughout the hollow interior, vacuum effects, on an image being conditioned, of a vacuum source connected to the hollow interior.

DESCRIPTION OF THE DRAWINGS

Other aspects of the present invention will become apparent as the following description proceeds and upon reference to the drawings, in which.

DETAILED DESCRIPTION OF THE INVENTION

Figure 1:
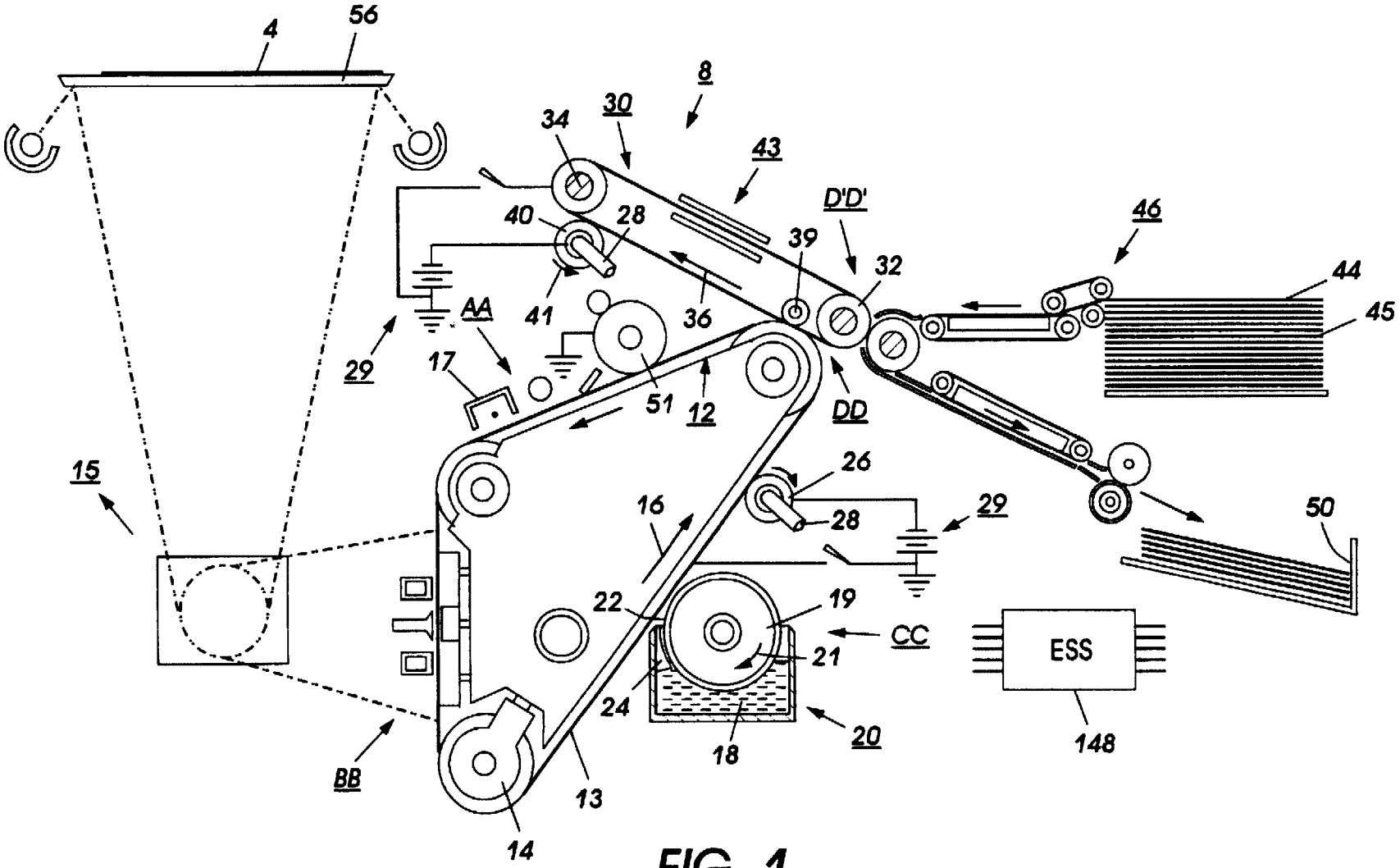
FIG. 1 is a schematic, elevational view of a single color black and white electrophotographic liquid toner reproduction machine incorporating a blotter roll formed in accordance with the method of the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 reproduction machines will be shown hereinafter only schematically, and their operation described only briefly.

Referring to FIG. 1, there is shown a reproduction machine 8 employing a belt 12 including a photoconductive surface 13 deposited on a conductive substrate. A roller 14 rotates and advances belt 12 in the direction of arrow 16. Belt 12 passes through charging station AA where a corona generating device 17 charges the photoconductive surface 13 of the belt 12 a portion at a time to a high and generally uniform potential. The charged portions of belt 12 are advanced sequentially to an exposure station BB where image rays from an original document 4 on a transparent platen 56 are projected by means of an optical system 15 onto the charged portion of the photoconductive surface so as to record an electrostatic latent image. Alternatively as is well known, a raster output scanner (ROS) device (not shown) can be used to write a latent image bitmap from digital electronic data by selectively erasing charges in areas of a charged portion on the charged belt 12. Such a ROS device writes the image data pixel by pixel in a line screen registration mode. In either case, it should be noted that the latent image can be thus formed for a discharged area development (DAD) process machine in which discharged areas are developed with toner, or for a charged area development (CAD) process machine in which the charged areas are developed with toner.

After the electrostatic latent image has been recorded thus, belt 12 advances to development station CC where a liquid developer material 18 including liquid carrier and charged toner particles from a chamber of a development apparatus 20 is advanced through a development zone or nip 22. At development station CC, a developer roller 19 rotating in the direction of arrow 21 advances liquid developer material 18 through the nip 22. An electrode 24 positioned before an entrance into development nip 22 is electrically biased so as to disperse the toner particles as solids in a substantially uniformly manner throughout the liquid carrier.

Development station CC also includes a porous blotter roller 26 having perforations through the skin surface thereof. Roller 26 made in accordance with the method of the present invention (to be discussed in detail below) is mounted so as to contact the liquid toner developed image on belt 12, and so as to condition the liquid image by reducing its fluid content (thereby increasing its percent solids) while at the same time inhibiting the departure of toner particles from the image.

U.S. Pat. No. 5,424,813, issued Jun. 13, 1995, to Schlueter et. al., and having a common assignee as the present application, (incorporated herein by reference) discloses a conditioning roller similar to the roller 26 that comprises an absorption material and a covering, which are adapted to absorb carrier liquid from a liquid developer image. The covering has a smooth surface with a plurality of perforations, to permit carrier liquid to pass through to the absorption material at an increased rate, while maintaining a covering having a smooth surface which is substantially impervious to toner particles yet pervious to carrier liquid so as to inhibit toner particles from departing the image. In addition, U.S. Pat. No. 5,481,341 issued Jan. 2, 1996 and having a common assignee as the present application, (and also incorporated herein by reference) discloses a similar roller for removal of excess carrier liquid from a liquid developed image, comprising a rigid porous electroconductive supportive core, a conformable microporous resistive foam material provided around the core, and a pressure controller for providing a positive or negative pressure to the roller.

The roller 26 operates in conjunction with a vacuum device 28 for removing the liquid carrier from the liquid toner image. A bias voltage 29 is applied to roller 26 so that a repelling force is present to prevent toner particles from leaving the photoconductive surface and entering the roller 26.

After the electrostatic latent image is developed, belt 12 advances the developed image to transfer station DD where the developed liquid image is electrostatically transferred from belt 12 to an intermediate member or belt 30. As shown, belt 30 is entrained about rollers 32 and 34, and is moved in the direction of arrow 36. A bias transfer roller 39 urges intermediate transfer belt 30 against image bearing belt 12 in order to assure effective transfer of the conditioned liquid toner image from belt 12 to the intermediate belt 30.

A second porous blotter roller 40 also made in accordance with the method of the present invention (to be described below), having perforations through the roller skin covering is provided. The roller 40 contacts the transferred image on belt 30 to further reduce its fluid content (increasing its percent solids) while preventing toner particles from departing from the image. The roller 40 by further removing excess liquid carrier as such increases the percent solids to between 25 and 75.% by weight, for example.

Increasing the percent solids of the transferred liquid toner image on the intermediate belt 30 is a particularly important function in a liquid color image developing process that utilizes multiple superimposed images of different colors.

In operation, roller 40 rotates in the direction of arrow 41 to impinge against the liquid toner image on belt 30. The porous body of roller 40 absorbs liquid from the surface of the transferred image. The absorbed liquid permeates through roller 40 and into an inner hollow cavity thereof, where the vacuum device 28 draws such liquid out of the roller 40 and into a liquid receptacle for subsequent disposal or recirculation as liquid carrier. Porous roller 40 then continues to rotate in the direction of arrow 41 to ensure continuous absorption of excess liquid from liquid toner images on transfer belt 30. A bias voltage 29 is applied to the roller 40 to establish a repelling electrostatic field against charged toner particles forming the images, thereby preventing such toner particles from transferring to the roller 40.

Belt 30 then advances the transferred image through a heating device 43 to a second transfer station D'D' where a sheet of support material 44 is advanced from stack 45 of such sheets by a sheet transport mechanism 46. The transferred image from the photoconductive surface of belt 30 is then attracted or transferred to copy sheet 44. After such transfer a, conveyor belt 46 moves the copy sheet 44 to a discharge output tray 50. As shown, after toner image transfer at transfer station DD, a cleaning device 51 including a roller formed of suitable material is driven into scrubbing engagement with the surface 13 of belt 12 in order to clean the surface 13.

Figure 2:
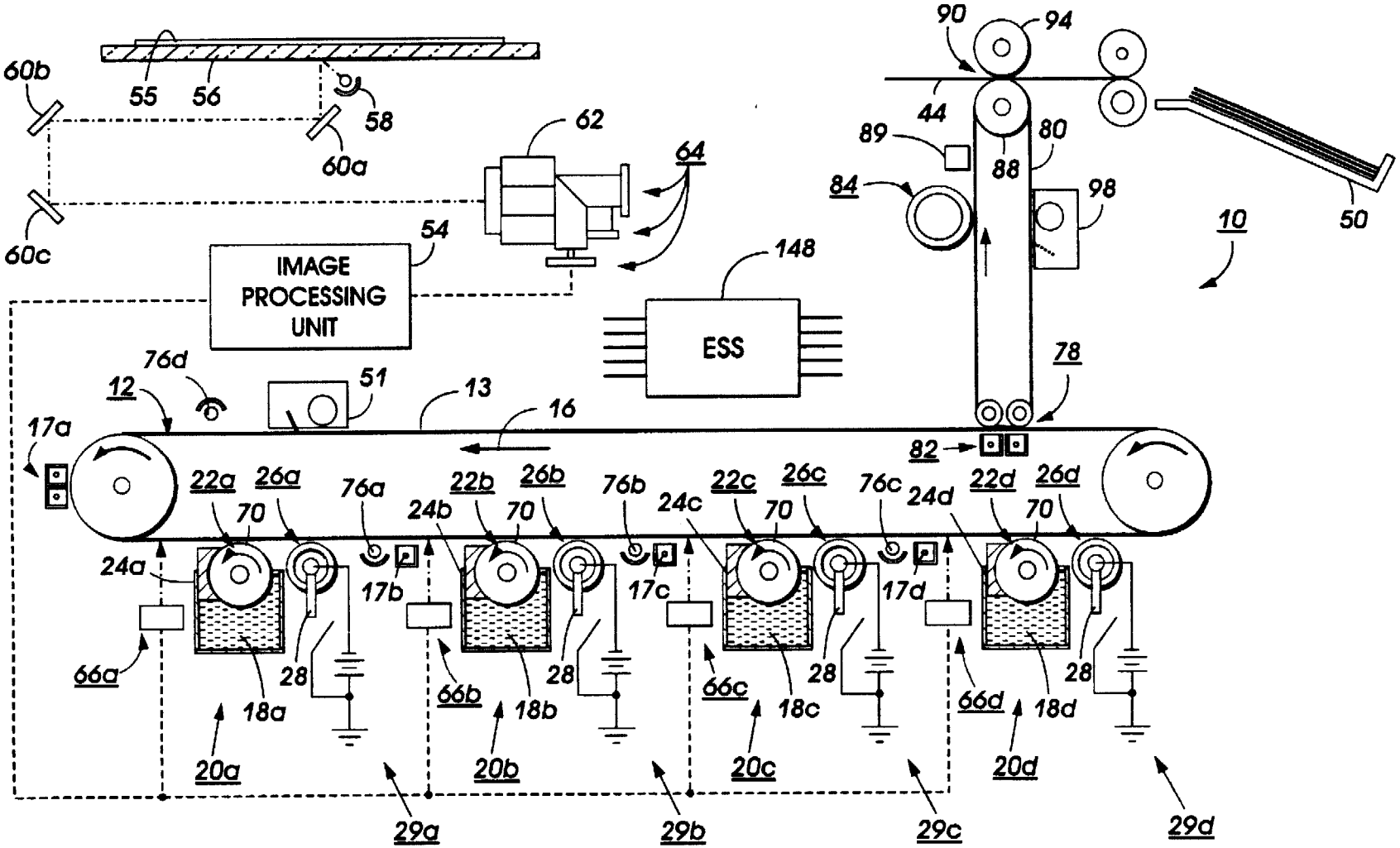
FIG. 2 is a color electrophotographic liquid toner reproduction machine incorporating blotter rolls each fabricated in accordance with the method of the present invention.

Turning now to FIG. 2, there is shown a color electrophotographic reproduction machine 10 incorporating post-transfix fusing apparatus. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors **60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54** can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive surface 13, and, in some embodiments, an anti-curl backing layer. As shown, belt 12 is movable in the direction of arrow 16. The moving belt 12 is first charged by a charging unit **17*a*. A raster output scanner (ROS) device 66*a*, controlled by image processing unit 54, then writes a first complementary color image bitmap information by selectively erasing charges on the charged belt 12. The ROS 66*a*** writes the image information pixel by pixel in a line screen registration mode. It should be noted that either discharged area development (DAD) can be employed in which discharged portions are developed or charged area development (CAD) can be employed in which the charged portions are developed with toner.

After the electrostatic latent image has been recorded thus, belt 12 advances the electrostatic latent image to development station 20*a*. At development station 20*a*, a development roller 70, rotating in the direction as shown, advances a liquid developer material 18*a*, preferably black toner developer material, from the chamber of a development housing to a development zone or nip 22*a*. An electrode 24*a* positioned before the entrance to development zone or nip 22*a* is electrically biased to generate an AC field just prior to the entrance to development zone or nip 22*a* so as to disperse the toner particles substantially uniformly throughout the liquid carrier. The toner particles, disseminated through the liquid carrier, pass by electrophoresis to the electrostatic latent image. As is well known, the charge of the toner particles is opposite in polarity to the charge on the photoconductive surface 13.

After the first liquid color separation image is developed, for example with black liquid toner, it is conditioned by a conditioning porous roller 26*a*, which is the same as rollers 26*b*, 26*c*, 26*d* (made in accordance with the present invention) having perforations through the roller skin covering. Roller 26*a* contacts the developed image on belt 12 and conditions the image by compacting the toner particles of the image and reducing the fluid content thereof (thus increasing the percent solids) while inhibiting the departure of toner particles from the image. Preferably, the percent solids in the developed image is increased to more than 20 percent by weight. Porous roller 26*a*, 26*b*, 26*c*, 26*d* operates in conjunction with a vacuum 28 which removes liquid from the roller. A pressure roller (not shown), mounted in pressure contact against the blotter roller 26*a*, may be used in conjunction with or in the place of the vacuum device 28, to squeeze the absorbed liquid carrier from the blotter roller for deposit into a receptacle.

In operation, roller 26*a*, 26*b*, 26*c*, 26*d* rotates in direction as shown to impose against the "wet" image on belt 12. The porous body of roller 26*a*, 26*b*, 26*c*, 26*d* absorbs excess liquid from the surface of the image through the skin covering pores and perforations. Vacuum device 28 located on one end of a central cavity of the roller 26*a*, 26*b*, 26*c*, 26*d*, draws liquid that has permeated into the roller, out through the cavity. Vacuum device 28 deposits the liquid in a receptacle or some other location for either disposal or recirculation as liquid carrier. Porous roller 26*a*, 26*b*, 26*c*, 26*d* then, continues to rotate in the direction as shown to provide a continuous absorption of liquid from the image on belt 12. The image on belt 12 advances to lamp 76*a* where any residual charge left on the photoconductive surface 13 of belt 12 is erased by flooding the photoconductive surface with light from lamp 76*a*.

As shown, according to the REaD process of the machine 10, the developed latent image on belt 12 is subsequently recharged with charging unit 17*b*, and is next re-exposed by ROS 66*b*. ROS 66*b* superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration. At development station 20*b*, a development roller 70, rotating in the direction as shown, advances a liquid developer material 18*b* from the chamber of development housing to development a zone or nip 22*b*. An electrode 24*b* positioned before the entrance to development zone or nip 22*b* is electrically biased to generate an AC field just prior to the entrance to development zone or nip 22*b* so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image.

A second conditioning roller 26*b* contacts the developed image on belt 12 and conditions the image by compacting the toner particles of the image and reducing fluid content while inhibiting the departure of toner particles from the image. Preferably, the percent solids is more than 20 percent, however, the percent of solids can range between 15 percent and 40 percent. The images on belt 12 advances to lamp 76*b* where any residual charge left on the photoconductive surface is erased by flooding the photoconductive surface with light from lamp 76.

To similarly produce the third image using the third toner color, for example magenta color toner, the developed images on moving belt 12 are recharged with charging unit 17*c*, and re-exposed by a ROS 66*c*, which superimposes a third color image bitmap information over the previous developed latent image. At development station 20*c*, development roller 70, rotating in the direction as shown, advances a magenta liquid developer material 18*c* from the chamber of development housing to a development zone or nip 22*c*. An electrode 24*c* positioned before the entrance to development zone or nip 22*c* is electrically biased to generate an AC field just prior to the entrance to development zone or nip 22*c* so as to disperse the toner particles substantially uniformly throughout the liquid carrier. The toner particles, disseminated through the liquid carrier, pass by electrophoresis to the previous developed image. A conditioning roller 26*c* contacts the developed images on belt 12 and conditions the images by reducing fluid content so that the images have a percent solids within a range between 15 percent and 40 percent. The images or composite image on belt 12 advances to lamp 76*c* where any residual charge left on the photoconductive surface of belt 12 is erased by flooding the photoconductive surface with light from the lamp.

Finally, to similarly produce the fourth image using the fourth toner color, for example cyan color toner, the developed images on moving belt 12 are recharged with charging unit 17*d*, and re-exposed by a ROS 66*d*. ROS 66*d* superimposes a fourth color image bitmap information over the previous developed latent images. At development station 20*d*, development roller 70, rotating in the direction as shown, advances a cyan liquid developer material 18*d* from the chamber of development housing to a development zone or nip 22*d*. An electrode 24*d* positioned before the entrance to development zone or nip 22*d* is electrically biased to generate an AC field just prior to the entrance to development zone or nip 22*d* so as to disperse the toner particles substantially uniformly throughout the liquid carrier. The toner particles, disseminated through the liquid carrier, pass by electrophoresis to the previous developed image. A conditioning roller 26*d* contacts the developed images on belt 12 and conditions the images by reducing fluid content so that the images have a percent solids within a range between 15 percent and 40 percent.

The resultant composite multicolor image, a multi layer image by virtue of different color toner development by the developing stations 20*a*, 20*b*, 20*c* and 20*d*, respectively having black, yellow, magenta, and cyan, toners, is then advanced to an intermediate transfer station 78. It should be evident to one skilled in the art that the color of toner at each development station could be in a different arrangement.

At the transfer station 78, the resultant multicolor liquid image is subsequently electrostatically transferred to an intermediate member 80 with the aid of a charging device 82. Intermediate member 80 may be either a rigid roll or an endless belt, as shown, having a path defined by a plurality of rollers in contact with the inner surface thereof. It is preferred that intermediate member 80 comprise at least a two layer structure in which the substrate layer has a thickness greater than 0.1 mm and a resistivity of $10^6$ ohm-cm. An insulating top layer has a thickness less than 10 micron, a dielectric constant of 10, and a resistivity of $10^{13}$ ohm-cm. The top layer also has an adhesive release surface. Also, it is preferred that both layers each have a matching hardness less than 60 durometer. Preferably, both layers are composed of Viton™ (a fluoroelastomer of vinylidene fluoride and hexafluoropropylene) which can be laminated together.

The multicolor image on the intermediate transfer member 80 is conditioned again for example by a blotter roller 84(also made in accordance with the present invention) which reduces the fluid content of the transferred image by compacting the toner particles of the image while inhibiting the departure of toner particles from the image. Blotter roller 84 is adapted to condition the image so that it has a toner composition of more than 50 percent solids.

Subsequently, the multicolor image on the surface of the intermediate member 80 is advanced through a liquefaction stage before being transferred within a second transfer nip 90 to an image recording sheet 44. Within the liquefaction stage, particles of toner forming the transferred image are transformed by a heat source 88 into a tackified or molten state. The heat source 88 can be applied to member 80 internally, for example. Preferably, the tackified toner particle image is then transferred, and bonded, to recording sheet 44 with limited wicking by the sheet. More specifically, the liquefaction stage also includes an external heating element 89 which heats the external surface of the intermediate member 80 within a transfix nip 90 and to a temperature sufficient to cause the toner particles present on such surface to melt. The toner particles on the surface, while softening and coalescing due to the application of such heat internally and externally of the intermediate transfer member 80, ordinarily maintain the position in which they were deposited on the outer surface of member 80, thereby not altering the image pattern which they represent.

Within the transfixing nip 90, the multicolor image is not only transferred to the recording sheet 44, but it is also expected to be fused or fixed to acceptable fix levels by the application of appropriate heat and pressure. For example, at transfix nip 90, the liquefied toner particles are heated to a temperature of 80 to 100 degrees C., and are forced by a normal force applied through a backup pressure roll 94, into contact with the surface of recording sheet 44. Moreover, recording sheet 44 may have a previously transferred toner image present on a surface thereof as the result of a prior imaging operation, i.e. duplexing.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet 44. Furthermore, the transfixed image becomes permanent once allowed to cool below their melting temperature. As shown, the surface of the intermediate transfer belt 80 is thereafter cleaned by a cleaning device 98 prior to receiving another toner image from the belt 12.

Referring now to FIGS. 3A to 5, there is shown a blotter roller 150 to collectively represent the blotter rollers 26, **26*a*–26*d*, 40 and 84 of FIGS. 1 and 2, as well as devices and apparatus for forming the same in accordance with the method of the present invention. Thus, identical elements associated with blotter rollers 26, 26*a*–26*d*, 40 and 84 will be identified with like reference numerals in the blotter roller 150**.

Conventionally, blotter rolls include a rigid cylindrical core that has perforations therethrough. Such a rigid cylindrical core may be produced, for example, by perforating a flat sheet of material as by stamping a sheet of stainless steel, nickel or aluminum. The perforated sheet is then rolled into a cylindrical shape and its adjoining ends, whether straight, spiral or overlapped, are then seamed or joined together, for example, by welding, soldering, or by adhesive bonding. In order to prevent a final blotter roll made from such a cylinder from detrimentally disturbing an image being conditioned, the seam line formed in joining the ends of the shaped cylinder together must be secondarily ground so as to make it precisely even and level with the outer circumference of the cylinder. Excellent mechanical tolerances can be assured in such a cylinder but only at a relatively greater cost in proper selection of the starting materials, fixtures, and equipment needed for its fabrication.

Alternately, such a rigid core can be made by perforating a premade unperforated tubular member or blank by a suitable method. The tubular blank ordinarily would have to be rigid, and probably would be deformed during the perforation process. As such, it would have to be straightened after perforation in order to achieve required straightness and mechanical tolerances.

Unfortunately however, the structure of liquid images conditioned with conventional blotter rollers made from such rigid substrates or cores, have been found to undesirably show significant evidence of pore hole outlines, and imprints or footprints from the rigid core substrate. In addition, the effect of vacuum applied through an unfilled cavity within the core is believed to leave a significant non-uniform appearance in the conditioned image between image areas contacted by pore (i.e. open) areas, and by non-pore or closed areas the blotter roll.

Figure 3A:
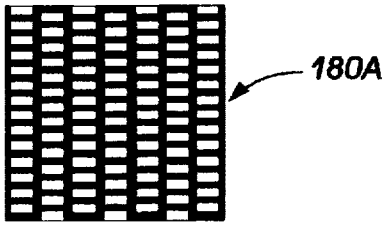
FIG. 3A, 3B, 3C and 3D are illustrated sample stencils for use in the method of fabricating a semi-rigid and resilient substrate for the blotter rolls of FIG. 1 and FIG. 2 in accordance with the present invention.
Figure 3B:
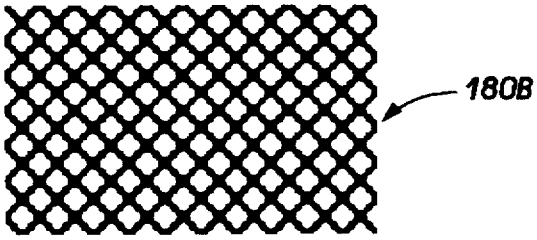
Figure 3C:
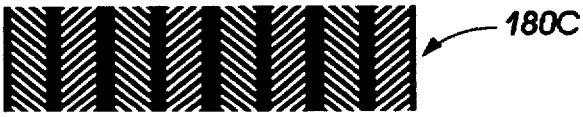
Figure 3D:
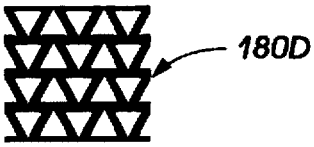

As shown (in FIG. 5) the blotter roll 150 includes a seamless, semi-rigid and resilient substrate 152 made in accordance with the method of the present invention. With reference to FIGS. 3A to 3D, stencils are illustrated for use in forming the semi-rigid and resilient substrate of the blotter roller 50 in accordance with the electroforming method of the present invention. To electroform the substrate 152, a substrate forming electrode 154 (FIG. 4) is patterned with a resist or a removable paint using a suitable stencil (FIGS. 3A–3D) in order to prevent substrate metal deposition in the resist covered areas on the electrode. The stencil 180 of FIG. 3B for example has an end staggered pattern of 0.050"×0.125" oblong perforations on 3/32" centers. The stencil of FIG. 3C represents a staggered mini-leaf pattern of perforations; and that of FIG. 3D represents an alternating inverted triangular pattern of perforations. The stencil 180A of FIG. 3A shows alternating reverse angle slots that are 17/32" long and 0.032" wide. Other stencil patterns including, for example, staggered or straight hole patterns, and square or triangular stabbed perforations, may also be used. The resist can be applied on the electrode by any suitable process such as by silk screening. The resist pattern is later removed from the electrode after the semi-rigid and resilient substrate has been formed on the electrode stencils. The substrate is then separated from the electrode.

An electroforming process suitable for use in forming the semi-rigid and resilient substrate 152 is described for example in U.S. Pat. No. 4,501,646 ('646 patent) which is commonly assigned, and is incorporated herein by reference. As disclosed therein, an endless metal belt can be electroformed without a taper and then separated from the electroforming mandrel via differences in linear coefficients of expansion between the mandrel and the electroformed belt, with internal stress control and hysteresis respectively of the belt.

Figure 4:
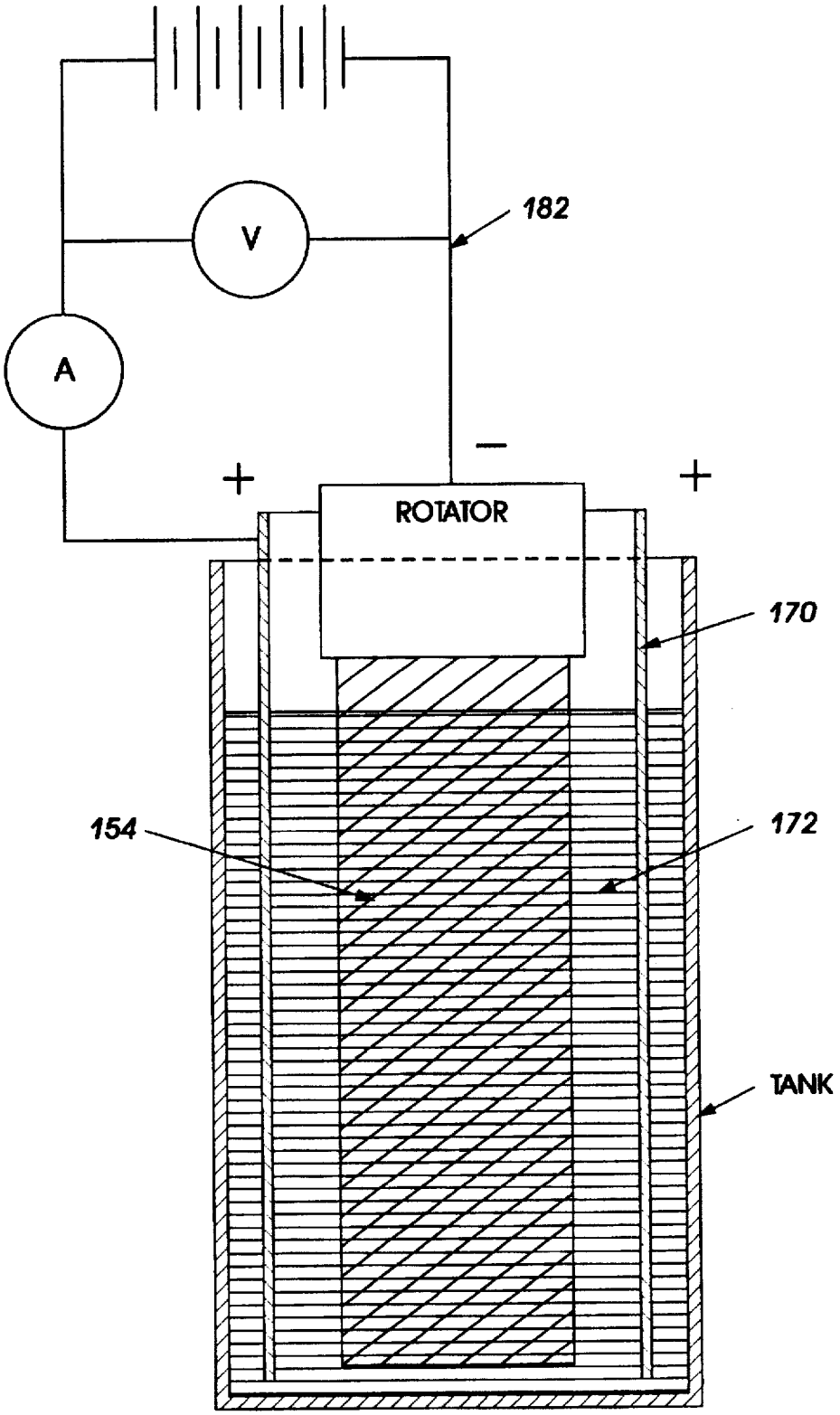
FIG. 4 is schematic of an electroforming apparatus for forming a semi-rigid and resilient substrate for the blotter rolls of FIG. 1 and FIG. 2.

As shown for example in FIG. 4, the method of the present invention for electroforming the substrate 152 thus includes providing a cylindrical core mandrel comprising a cathode electrode 154, a metallic anode electrode 170 and a bath 172 of a nickel salt solution. The method next includes heating the bath and the mandrel to a temperature sufficient to expand the cross-sectional area of the mandrel, and applying an electrical current across the electrodes so as to electroform a controlled and uniform nickel substrate coating 152 around the mandrel. To separate the nickel substrate 152 from the mandrel 154, the method includes a step of rapidly cooling the external surface of the nickel substrate on the mandrel in order to restrict cool-through contraction of the inner perimeter of the substrate in contact with the heated mandrel. The method then includes subsequently cooling and contracting the cross-sectional area of the mandrel relative to the inner perimeter of the rapidly cooled substrate, thus enabling the substrate to be separated from the mandrel, while retaining the external dimensions of the expanded mandrel. The substrate produced as such has been found to maintain the dimensions of the mandrel, thereby assuring good mechanical tolerances for diameter, straightness and total indicated run-out end to end.

The wall thickness of such an electroformed semi-rigid and resilient perforated substrate generally can be up to about 0.010 of an inch thick. In accordance with the preferred method of the present invention, the substrate 152 of the roller 150 is made by a nickel electroforming process. Initially, the forming electrode 154 having an outer diameter "d" of approximately 1.5" is covered with a desired stencil 180A, 180B, 180C, 180D having a pattern of holes or perforations, such as shown in FIGS. 3A to 3D. Next, a resist or clear acrylic spray paint is applied through the holes or perforations of the stencil to the forming electrode 154, such that the resist or paint is applied to the electrode only in the hole areas of the stencil. The painted forming electrode is then dried, and the stencil is removed disclosing a pattern of painted and interconnected unpainted surface areas.

The forming electrode 154 as such is then connected to an appropriate voltage source 182 and then immersed into a nickel electrodeposition bath 172. In the bath, nickel gradually deposits in a controlled manner only in the interconnected unpainted surface areas of the electrode. No deposits occur in the painted areas. The forming electrode 154 with a desired thickness of nickel deposit on it is then removed from the bath, washed, dried, and treated with methyl ethyl ketone in order to remove the paint from the painted areas. The forming electrode is then separated from the nickel layer in a manner as taught in the '646 patent, leaving a desired hollow and semi-rigid and resilient perforated nickel cylindrical substrate for use in making the blotter roller 150.

Figure 5:
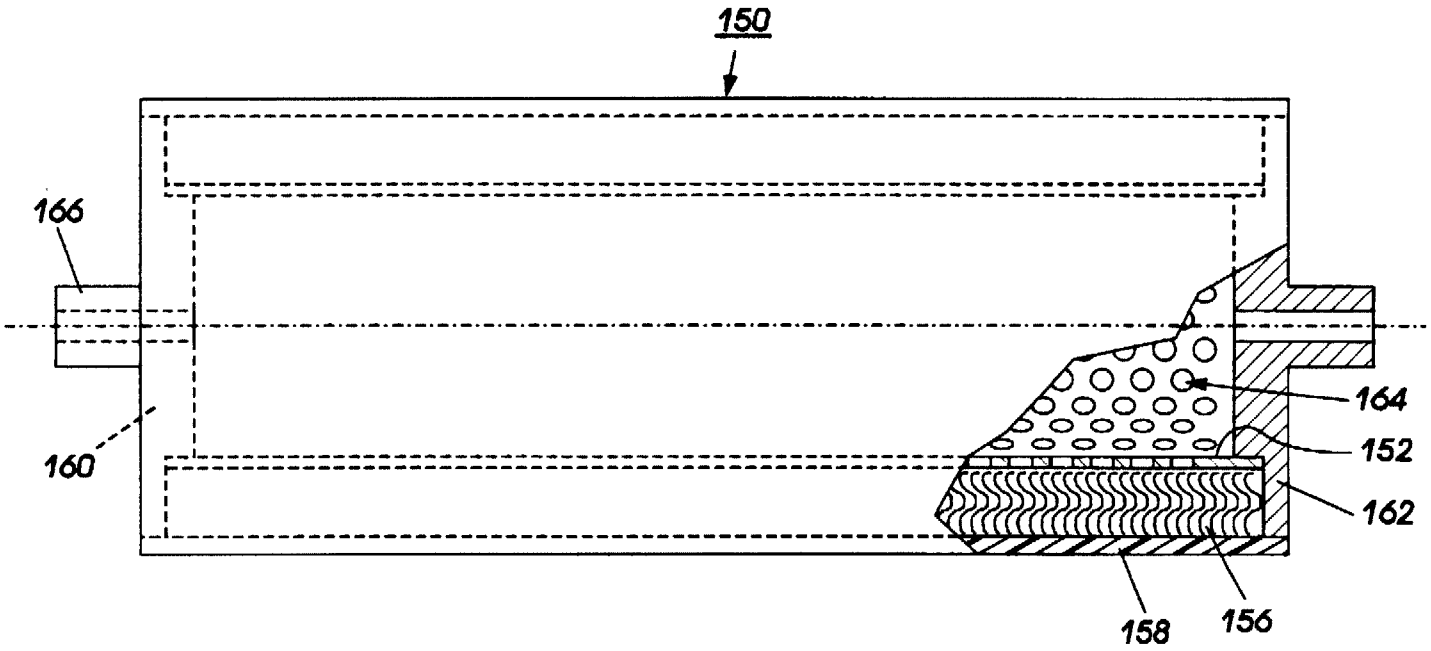
FIG. 5 is an enlarged schematic, sectional longitudinal view of the blotter roll of FIGS. 1 and 2.

As shown in FIG. 5, the blotter roller 150 includes an absorbent, intermediate porous open cell foam material layer or sleeve 156 that is formed over the semi-rigid and resilient substrate 152. The open cell foam material layer 156 has a typical pore size of about 0.05", and is available, for example, as a firm hydrophylic foam with a thickness of about 0.125" from Time release Sciences, Inc. The blotter roll 150 also includes a microporous skin covering or surface layer 158 that is formed over the foam material layer 156 and has a typical pore size of 0.00025". The vacuum system 28 (FIGS. 1 and 2) is ordinarily connected to one of a pair of removable journal ends 160, 162, and operates to draw carrier liquid through the various outer layers 156, 158, into and through an inner open cell foam insert 164 that fills the interior of the semi-rigid and resilient substrate 152. According to the method of the present invention, the inner open cell foam insert 164 is inserted snugly through the hollow interior 168 of the perforated semi-rigid and resilient substrate 152 for strengthening the overall blotter roll 150 in operation.

Importantly, the inner open cell foam insert 164 also serves to attenuate the effect of vacuum applied therethrough to the image being conditioned so as to leave an insignificant difference in appearance in the conditioned image between pore (i.e. open) areas and non-pore or closed contacted areas of the image. The durometer and pore size of the foam insert 164 is selected so as to regulate the stiffness of the blotter roll 150, as well as to regulate the capillary flow rate of carrier liquid from the image being conditioned. The insert foam 164 may be electrically conductive, and may be foamed in place directly into the cavity of the substrate 152, if desired.

The end journals 160, 162 of the final roll 150 are made so as to fit into each open end of the electroformed substrate 152, and for mounting within a machine. The end journals as such include hollow shafts 166 in order to enable connection to the vacuum system 28. The end journals can be attached removably to each end of the perforated substrate 152 using RTV or other suitable sealant, for example.

The design and assembly of the blotter roll 150 as such are to enable easy reclaim and recycling of the electroformed perforated substrate 152, as well as of the journals 160, 162 and any of the open cell foam components. The blotter roll 150 as such is lower in material and fabrication costs. The perforated substrate 152, for example, is reclaimed by removing the absorbent and outer surface foam layers 156, 158 and the RTV sealed end journals. Next, the interior rigidifying foam insert 164 is then removed. New foam components can be reassembled to replace the interior foam insert 164, and to the exterior of the substrate to replace the layers 156, 158. The end journals 160, 162 are then refitted and resealed with RTV to create a recycled blotter roll 150 that is ready for reuse in a machine. The nickel substrate 152 alternatively can be recycled by being dissolved and reused in electroforming anew a semi-rigid nickel substrate in accordance with the present invention.

The structure of a liquid image conditioned with a blotter roller 150 made in accordance with the method of the present invention was found to show no evidence of any pore hole outline of the roller, and no imprint from the semi-rigid and resilient substrate or from the surface layers 156, 158. Toner offset from the image to the blotter roll was also relatively insignificant.

The advantages of the above method steps and structure for forming the blotter roll 150 for the low solids image conditioning, include the electroformed, semi-rigid and resilient perforated substrate that leaves no significant hole or footprint outlines on a conditioned image, and the inner open cell foam insert 164 within the substrate 152 for filling the cavity of the semi-rigid and resilient substrate. In addition to being useful for rigidifying the semi-rigid and resilient substrate, the inner foam insert 164 additionally operates to attenuate conditioning differences between pore and non-pore contacted areas of the image being conditioned, thus resulting in a more uniformly conditioned image.

While the invention has been described with reference to particular preferred embodiments, the invention is not limited to the specific examples shown, and other embodiments and modifications can be made by those skilled in the art without departing from the spirit and scope of the invention and claims.

What is claimed is:

1. A method of fabricating a blotter roll for uniformly conditioning liquid images consisting of toner particles and carrier liquid, the method comprising:

(a) electroforming a semi-rigid resilient and perforated metallic substrate for preventing undesirable impressions of substrate outlines and footprints on an image being conditioned, and so that the resilient metallic substrate has a cylindrical hollow interior and first and second open ends;

(b) forming at least a first absorbent foam layer over the semi-rigid resilient substrate for absorbing carrier liquid from the image being conditioned; and (c) filling the cylindrical hollow interior of the semi-rigid resilient substrate using a porous foam insert for rigidifying the semi-rigid resilient substrate, and for uniformly spreading throughout the hollow interior, vacuum effects of a vacuum source connected to the hollow interior for drawing carrier liquid from the image being conditioned.

2. The method of claim 1, wherein said step of electroforming the semi-rigid resilient substrate comprises electroforming, in a nickel salt electrodeposition bath, a thin nickel substrate coating around a cylindrical mandrel patterned using a removable perforated stencil and removable paint.

3. The method of claim 2, including a step of rapidly cooling an external surface of the thin nickel substrate around the mandrel so as to restrict cool through contraction of the inner perimeter of the substrate, thereby causing the inner perimeter of the substrate to retain an outer diameter of the mandrel.

4. A blotter roll for uniformly conditioning liquid toner images consisting of toner particles and carrier liquid, the blotter roll comprising:

(a) a surface foam layer having micro-pores for contacting an image being conditioned to absorb carrier liquid without removing toner particles;

(b) an absorbent intermediate foam layer formed underneath said surface foam layer for absorbing carrier liquid from the surface layer;

(c) an electroformed semi-rigid and resilient metallic substrate underneath said intermediate foam layer, said metallic substrate having a cylindrical hollow interior, through perforations, and first and second open ends;

(d) a rigidifying porous foam insert fitted within said cylindrical hollow interior of said semi-rigid metallic substrate for rigidifying the metallic substrate, and for uniformly spreading throughout the hollow interior, vacuum effects of a vacuum source connected to said hollow interior for drawing carrier liquid from the image being conditioned; and (e) end journals removably attached to said first and second open ends for enabling recycling of said resilient substrate and of said end journals by replacing said porous foam insert and said surface and said intermediate foam layers.

* * * * *